US006598759B2

(12) United States Patent
Carriere

(10) Patent No.: US 6,598,759 B2
(45) Date of Patent: Jul. 29, 2003

(54) DISPENSING CONTAINER

(76) Inventor: Jules Carriere, 3850 Lavoie, St-Hubert, QBC (CA), J3Y 5E4

( * ) Notice: Subject to any disclaimer, the term of this patent is extended or adjusted under 35 U.S.C. 154(b) by 24 days.

(21) Appl. No.: 10/058,748

(22) Filed: Jan. 30, 2002

(65) Prior Publication Data

US 2002/0100763 A1 Aug. 1, 2002

Related U.S. Application Data

(60) Provisional application No. 60/265,106, filed on Jan. 31, 2001, now abandoned.

(51) Int. Cl.[7] ..... A47K 10/24
(52) U.S. Cl. ..... 221/45; 312/61
(58) Field of Search ..... 221/33, 45, 46, 221/52, 49, 61, 48, 63, 308, 310; 206/449, 494; 312/50, 61

(56) References Cited

U.S. PATENT DOCUMENTS

D289,841 S 5/1987 Braun
D290,074 S 6/1987 Braun
4,768,679 A 9/1988 Matsui
5,931,339 A * 8/1999 Dodge et al. ..... 221/45
D426,990 S 6/2000 Mitchell
6,241,118 B1 * 6/2001 Tramontina ..... 221/45

* cited by examiner

*Primary Examiner*—Kenneth W. Noland

(57) ABSTRACT

A dispensing container for storing a stack of relatively flexible objects in a storage section and for individually dispensing a lowermost object of the stack to an intended user. The storage section defines a dispensing end, an opposed inlet end and opposed first and second storage walls extending there between. The container includes a releasable retaining protrusion extending from the first storage wall adjacent a dispensing port of the dispensing end to releasably retain the objects within the storage section, with a portion of the weight of the objects being supported by the first storage wall with the objects abutting thereon. The retaining protrusion supports the edges of the lowermost object while leaving an edge unsupported and accessible for grasping through the dispensing port and allows the lowermost object to be deformed when grabbed by the intended user so that its supported edges clear the retaining protrusion for the lowermost object to be dispensed there through.

20 Claims, 4 Drawing Sheets

DISPENSING CONTAINER

CROSS-REFERENCE TO RELATED APPLICATION

This application is related to the provisional application for patent Ser. No. 60/265,106 filed Jan. 31, 2001, now abandoned.

FIELD OF THE INVENTION

The present invention relates to the general field of article handling accessories and is particularly concerned with a dispensing container for selectively dispensing relatively flexible objects such as envelopes, magazines and the like.

BACKGROUND OF THE INVENTION

There exists a variety of situations wherein it is desirable to selectively dispense individual objects. In particular, there exists numerous situations wherein it desirable to store and individually dispense relatively flexible objects such as magazines, flyers, envelopes or the like. A typical, although by no means exclusive example, can be found in the art associated with automated teller machines often referred to as ATMs.

The automated teller machines are typically located in lobbies of banking institution buildings so as to be accessible even outside regular banking hours. These automated teller machines are typically used directly by consumers both to receive deposits and to dispense money. In order to allow for the deposit of various types of currencies, checks and money orders, the automated teller machine user is often asked to insert the deposit in a predetermined type of envelope.

The deposit envelopes are often stacked in dispensing containers formed integrally as part of the automated teller machine or adjacent the latter. Various types of dispensing containers using various types of dispensing mechanisms have heretofore been used. However, most dispensing containers for deposit envelopes have proven to be unsatisfactory.

Most prior art envelope dispensing containers include a box-like enclosure having a dispensing port positioned adjacent a lower section thereof. The envelopes are stacked into the box-like enclosure with the lowermost envelope being prevented from falling through the dispensing port by various types of abutment structures. Containers of this type have the advantage that even the very last envelope can be dispensed from the container without any particular difficulty since the envelopes move spontaneously towards the bottom of the container by gravity as they are consumed.

However, one of the main drawbacks associated with this type of prior art envelope dispensing containers is that they often lead to wastage of envelopes unwantingly dispensed with the lowermost envelope. The unwanted dispensing of overlying envelopes along with the lowermost envelop often results either from frictional forces between the lowermost envelope and overlying envelopes or from the intended user unwantingly grasping more than one envelope.

Indeed, the envelopes being merely stacked on top of each other, the weight of the stack often creates an excessive frictional force between the lowermost envelope and the overlying envelope. The same type of frictional contact is also often present between contacting surfaces of other adjacent envelops located adjacent the bottom of the stack. The frictional forces sometimes drag adjacent envelopes along with the lowermost envelope as the latter is being pulled through the dispensing port.

Also, since the envelopes are merely stacked on top of each other, the weight of the stack forces the edge of the lowermost envelope being grasped by the intended user into a proximal relationship with the similar adjacent edge of the overlying envelopes. Hence, it is often difficult for the intended user to isolate the edge of the lowermost envelope. Consequently, the intended user often unwantingly grasps and draws overlying envelops along with the lowermost envelope.

As a result, envelopes overlying the lowermost envelopes are often unwantingly pulled out of the dispensing port. These unwantingly withdrawn envelopes are at best left on a counter adjacent the dispensing container creating a messy situation on the counter and potentially tarnishing the public image of the banking institution. Often times, they even fall to the ground adjacent the automated teller machine creating an even messier situation. Not only does this situation lead to an unsightly mess but it also leads to the costly and environmentally detrimental waste of paper objects.

The same type of problem arises with conventional dispensing containers used for other purposes such as the dispensing of flyers, magazines, other printed publications, stamps, wrapped objects and any relatively flexible dispensed object stored in a stacked configuration. Accordingly, there exists a need for an improved dispensing container.

SUMMARY OF THE INVENTION

Advantages of the present invention include that the proposed dispensing container allows for storage of a stack of relatively flexible objects and selective individual dispensing thereof. The proposed dispensing container facilitates grasping by an intended user of the lowermost object in the stack with reduced risks of having the intended user unwantingly grasp overlying objects.

Also, the proposed dispensing container allows for a reduction in the frictional force between the lowermost object being dispensed and overlying objects stacked on top of the latter. This reduction in the frictional force between the lowermost object and overlying stacked objects, in turn, reduces the risks of having overlying objects unwantingly dragged along and dispensed with the lowermost object as the latter is being drawn by an intended user out of the dispensing port.

Furthermore, the proposed dispensing container allows for selective and individual dispensing of a lowermost object through a set of quick and ergonomical steps without requiring manual dexterity on behalf of the intended user. Also, the proposed dispensing container allows for both storage and dispensing of objects with reduced risks of damaging the latter during both the storage and dispensing operations.

Still furthermore, the proposed dispensing container optionally reduces the risks of unwanted tampering with the objects stored within the container and of tampering with the dispensing container itself. Still further, the proposed storage container optionally provides for centering of the objects stored therein so as to facilitate optimal positioning of the objects within the container and so as to further reduce the risks of damaging the objects stored within.

Also, the proposed dispensing container optionally allows selective dispensing of the objects without requiring contact of the intended user with the objects prior to having the objects leaving the dispensing port. Still furthermore, the proposed storage container may optionally be positioned adjacent similar dispensing containers and allowed to dispense objects stored within the adjacent containers according to a predetermined dispensing sequence or pattern.

Overall, the proposed dispensing container is designed so as to be easily manufacturable using conventional materials and through a set of conventional manufacturing steps so as to provide a dispensing container that will be economically feasible, long-lasting and relatively trouble-free in operation.

According to the present invention, there is provided a dispensing container for storing a stack of relatively flexible objects and for individually dispensing a lowermost object of the stack to an intended user, each of the objects defining a object first main edge, a generally opposed object second main edge and an object grasping edge, the object first and second main edges defining an object main edge distance therebetween, each of the objects defining a corresponding object main geometrical plane intercepting the object first and the object second main edges, the dispensing container comprises: a storage section for storing the objects in a stacked relationship to each other, the storage section defining a storage section dispensing end, a generally opposed storage section inlet end and a storage section axis extending between the storage section dispensing end and inlet ends, the storage section dispensing end defining a dispensing port; the storage section including a first storage wall and a generally opposed second storage wall each extending substantially from the storage section dispensing end to the storage section inlet end; the first and second storage walls respectively defining a first storage wall inner surface and a generally opposed second storage wall inner surface; a releasable retaining means mounted within the storage section adjacent the storage section dispensing end for releasably retaining the objects within the storage section, the releasable retaining means being configured and sized for releasably supporting the object first and second main edges of at least the lowermost object while leaving the grasping edge of at least the lowermost object unsupported and accessible for grasping through the dispensing port; the releasable retaining means being further configured and sized for allowing the lowermost object to be deformed when grabbed by the intended user so that the object first and second main edges of the lowermost object are allowed to clear the retaining means and the lowermost object is dispensed through the dispensing port.

Preferably, the retaining means supports the object first and the object second main edges of a plurality of the objects so as to reduce the frictional force between the lowermost object and overlying stacked objects.

Conveniently, the retaining means is further configured and sized so as to allow the object grasping edge of the lowermost object to drop through the dispensing port under the action of gravity thereon while the object first and second main edges of the lowermost object remain supported by the retaining means so that the object grasping edge of the lowermost object becomes spaced relative to the object grasping edge of an overlying object creating a grasping edge spacing therebetween, whereby the grasping edge spacing facilitates the grasping of the object grasping edge of the lowermost object by the intended user.

Preferably, the retaining means includes a retaining protrusion extending from the first storage wall inner surface adjacent the storage section dispensing end; the dispensing container further comprising an object positioning means mounted within the storage section for positioning the objects in an angled configuration wherein the object main geometrical plane of the objects are angled relative to both the storage section axis and a reference axis perpendicular to the storage section axis, the angled configuration being such that the object first main edge is positioned lower than the object second main edge, whereby, when in the angled configuration, a portion of the weight of the objects is supported by the first storage wall with the object first main edge abuttingly contacting the first storage wall inner surface.

Preferably, the objects in the angled configuration are angled by an object angle, the object angle having a value of about between zero (0) and fifty (50) degrees relative to the reference axis.

Conveniently, the first and second storage walls extend in a generally parallel relationship relative to each other and define a generally perpendicular dispensing aperture therebetween, the object main geometrical plane being in an angled relationship relative to both the first and second storage walls and to the dispensing aperture.

Preferably, the dispensing container defines a wall distance between the first and second storage wall inner surfaces, the wall distance being greater or equal to the object main edge distance and wherein the positioning means includes a positioning protrusion extending from the second storage wall inner surface, the positioning protrusion defining a positioning protrusion abutment surface, the distance between the first storage wall inner surface and the positioning protrusion abutment surface being smaller that the object main edge distance so that when the objects are in their angled configuration, the object first main edge abuts against the first storage wall inner surface and the object second main edge abuts against the positioning protrusion.

Preferably, the positioning protrusion is a positioning strip mounted on the second storage wall inner surface and extending in a direction generally parallel relationship relative to the storage section axis.

Conveniently, the positioning strip defines a pair of positioning strip lateral edges and wherein the objects are provided with an object retaining recess formed in the object second main edge, the object retaining recess defining a pair of object recess edges, the positioning strip being configured and sized for substantially fitting insertion in the object retaining recess, whereby when the positioning strip is inserted in the object retaining recess, at least one of the object recess edges contacts one of the positioning strip lateral edges allowing the positioning strip to further act as a centering means and an auxiliary retaining means for centering the objects in the storage section and further releasably retaining the objects in the storage section.

Alternatively, the distance between the first and second storage wall inner surfaces is smaller than the object main edge distance so that when the objects are in their angled configuration, the object first main edges abuts against the first storage wall inner surface and the object second main edges abuts against the second storage wall inner surface.

Conveniently, the first storage wall defines corresponding first storage wall first and second transversal edges and the second storage wall defines corresponding second storage wall first and second transversal edges, the retaining protrusion extending from a position substantially adjacent the first storage wall first transversal edge to a position immediate the first storage wall first transversal edge and the first storage wall second transversal edge so as to define a retaining protrusion-to-second edge spacing between the retaining protrusion and the first storage wall second transversal edge.

Preferably, the retaining protrusion-to-second edge spacing has a value of about between one half to one twice the length of the retaining protrusion.

Preferably, the retaining protrusion has a generally elongated configuration defining a retaining protrusion longitudinal axis, the retaining protrusion longitudinal axis extending in an angled relationship relative to both the dispensing axis and the reference axis, the retaining protrusion longitudinal axis being angled towards the dispensing port in a direction leading towards the first storage wall second transversal edge.

Conveniently, the retaining protrusion is a generally elongated retaining strip attached to the first storage wall inner surface, the retaining strip defining a longitudinal retaining strip supporting edge and a generally perpendicular retaining strip dispensing edge, the intersection between the retaining strip supporting edge and the retaining strip dispensing edge defining a retaining strip corner, the retaining strip corner having a generally rounded contour.

Conveniently, the first storage wall defines corresponding first storage wall first and second transversal edges and the second storage wall defines corresponding second storage wall first and second transversal edges, the releasable retaining means including a first and a second retaining protrusion extending respectively from the first and second storage wall inner surfaces adjacent the storage section dispensing end, the first and second retaining protrusions extending from a position substantially adjacent the first and second storage wall first transversal edges to a position intermediate the first and second storage wall first and second transversal edges so as to define respective retaining protrusion-to-second edge spacings therebetween.

Preferably, the dispensing container further comprises a third storage wall extending between the first and second storage wall first transversal edges, the third storage wall defining a third storage wall inner surface, the dispensing container still further comprising a third retaining protrusion extending from the third storage wall inner surface adjacent the storage section dispensing end, the third retaining protrusion cooperating with the first and second retaining protrusions for releasably supporting the objects.

Alternatively, the first storage wall defines corresponding first storage wall first and second transversal edges and the second storage wall defines corresponding second storage wall first and second transversal edges, the retaining protrusion being a first retaining protrusion, the first retaining protrusion extending from a position substantially adjacent the first storage wall first transversal edge to a position intermediate the first storage wall first and second transversal edges so as to define a retaining protrusion-to-second edge spacing therebetween; the dispensing container further comprises a third storage wall extending between the first and second storage wall first transversal edges, the third storage wall defining a third storage wall inner surface, the dispensing container still further comprising a third retaining protrusion extending from the third storage wall inner surface adjacent the storage section dispensing end, the third retaining protrusion cooperating with the first retaining protrusion for releasably supporting the objects.

Conveniently, the dispensing container also defines a dispensing section extending from the storage section adjacent the storage section dispensing end, the dispensing section including a first dispensing wall extending from the first storage wall and a second dispensing wall extending from the second storage wall.

Conveniently, the dispensing container further comprises an dispensing mechanism, the dispensing mechanism including a selective engaging means for selectively engaging a surface of the lowermost object and exerting a dispensing force thereon, the dispensing force allowing the lowermost object to be deformed so that the lowermost object clears the retaining means and drops through the dispensing port.

Preferably, the engaging means includes an engagement shaft rotatably mounted on the dispensing container adjacent the dispensing port, the engagement shaft being provided with an engagement protrusion formed thereon, the engagement protrusion being configured and sized for engaging a surface of the lowermost object and exerting the dispensing force thereon upon rotation of the engagement shaft.

Other objects and advantages of the present invention will become apparent from a careful reading of the detailed description provided herein, within appropriate reference to the accompanying drawings.

BRIEF DESCRIPTION OF THE DRAWINGS

In the annexed drawings, like reference characters indicate like elements throughout.

FIGS. 4*a*, 4*b* and 4*c* are broken and enlarged front perspective views of the dispensing port of one of the dispensing containers of FIG. 1, illustrating the successive steps occurring during the dispensing of an object there through;

DETAILED DESCRIPTION OF THE PREFERRED EMBODIMENTS

With reference to the annexed drawings the preferred embodiments of the present invention will be herein described for indicative purpose and by no means as of limitation.

Figure 1A:
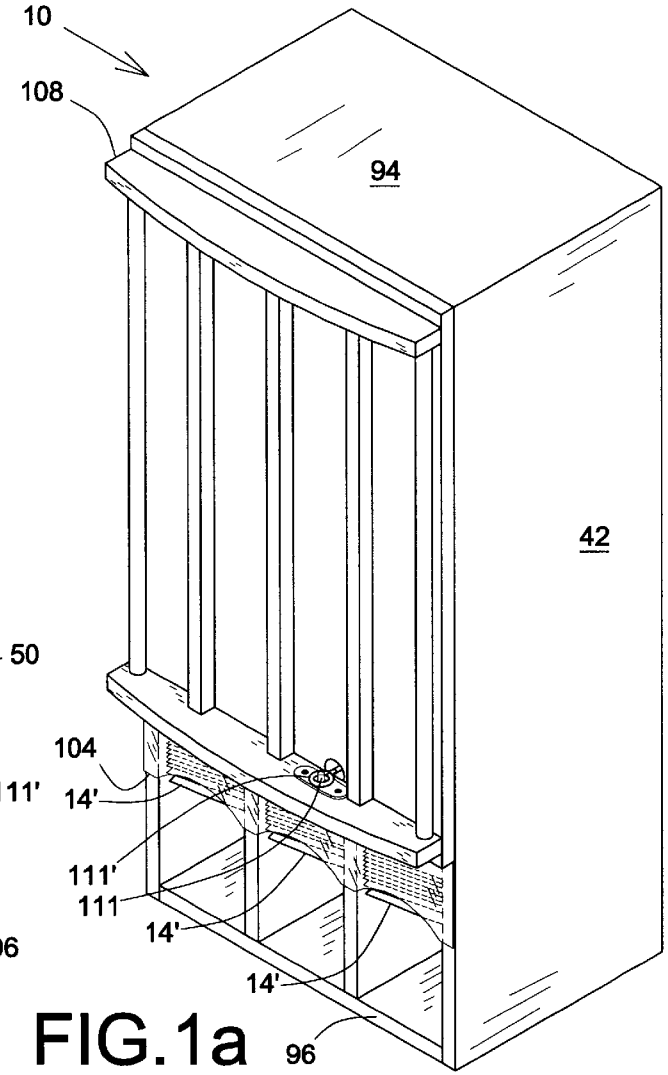
FIG. 1*a* is a view similar to FIG. 1, showing the embodiment of FIG. 1 with the cover door in close configuration.
Figure 1:
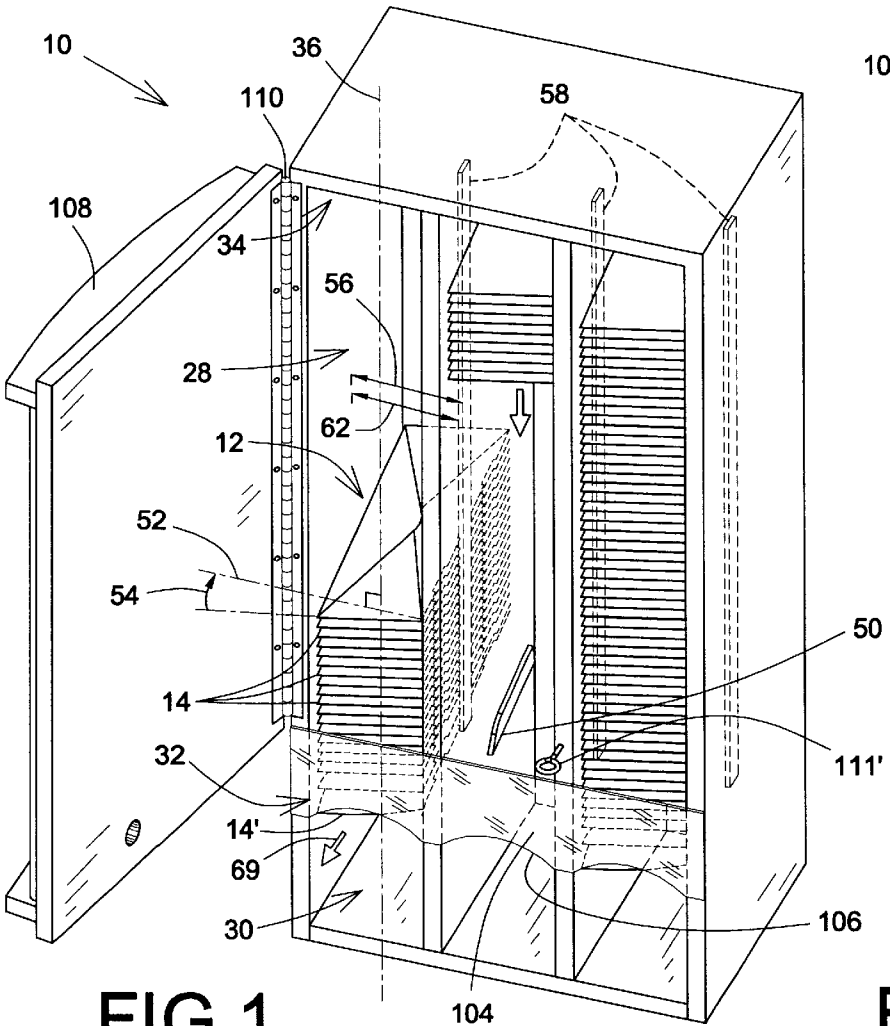
FIG. 1 is a front perspective view, showing three juxtaposed dispensing containers in accordance with an embodiment of the present invention with the common cover door in open configuration.

Referring to FIGS. 1 and 1*a*, there is shown a dispensing container 10 in accordance with an embodiment of the present invention. The dispensing container 10 is shown storing a stack 12 of relatively flexible objects 14. The dispensing container 10 allows individual dispensing of the lowermost object 14' of the stack 12 by the hand 16 of an intended user.

In some situations it may be desirable to allow the dispensing container 10 to selectively dispense a group of lowermost objects 14' such as the two or three lowermost objects 14' in the stack 12. It should thus be understood that although throughout the figures and the following description the dispensing containers 10 disclosed as intended for dispensing only the lowermost object 14' it could also be intended to dispense a selected group of lowermost objects 14' without departing from the scope of the present invention.

Figure 2:
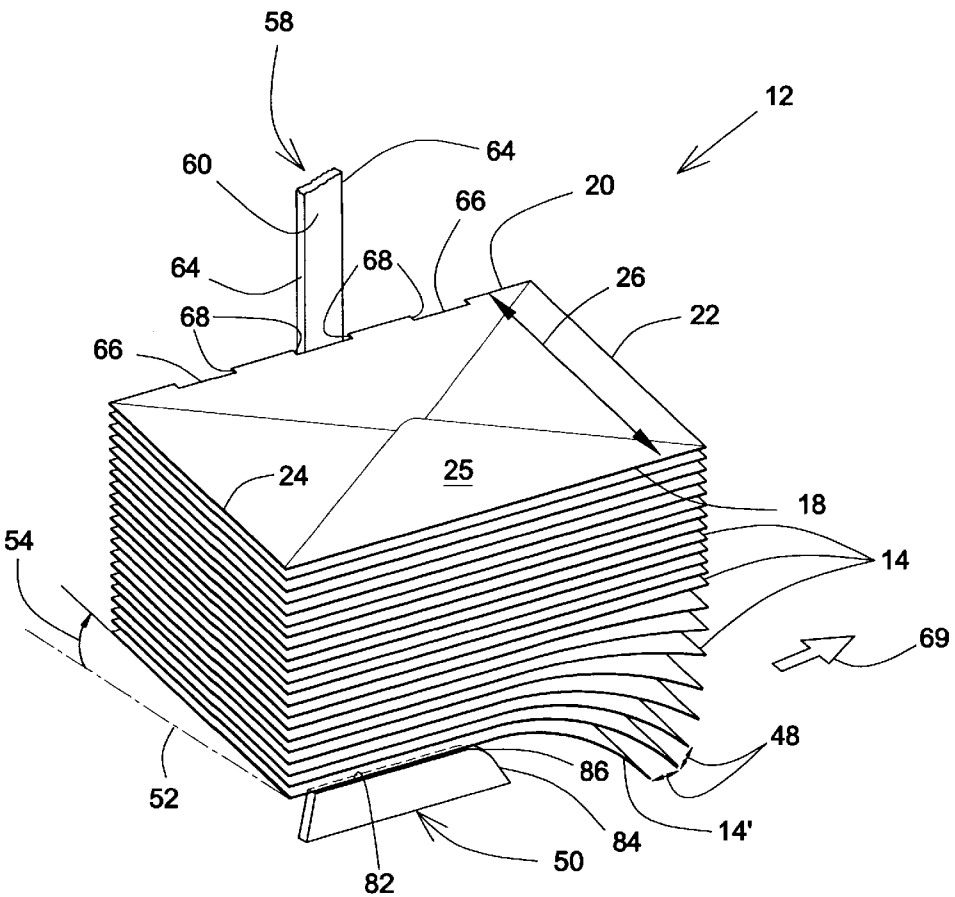
FIG. 2 is a back perspective view, showing a stack of objects supported by the retaining strip and abutting the protrusion strip when in the dispensing end of the storage section of the embodiment of FIG. 1.

As shown in FIG. 2, each object 14 typically defines a object first main edge 18, a generally opposed object second main edge 20, an object grasping edge 22 and a generally opposed object trailing edge 24. The object first and second main edges 18, 20 define an object main edge distance 26 therebetween. Each object 14 further defines a corresponding object main geometrical plane 25 intercepting the object first and second main edges 18, 20.

It should be understood that although the objects 14 are illustrated throughout the figures as being conventional envelopes such as the envelopes found adjacent automated teller or banking machines, the objects 14 could be of another nature without departing from the scope of the present invention. For example, the objects 14 could be flyers, catalogs, other printed publications, packaged food envelops, or any other suitable, relatively flexible objects without departing from the scope of the present invention.

Also, it should be understood that although the objects 14 are illustrated and described as being generally rectangular and flat in shape, they could assume other geometrical configurations such as being more bulky and/or generally triangular, polygonal or the like without departing from the scope of the present invention. Accordingly, although the dispensing container 10 is shown as having a generally parallelepiped-shaped configuration, it should be understood that the general configuration of the dispensing container 10 could vary in order to accommodate objects of different configurations without departing from the scope of the present invention.

The dispensing container 10 typically includes a storage section 28 overriding a dispensing section 30. It should however be understood that the dispensing container 10 could exclude the dispensing section 30, thus only including a storage section 28 without departing from the scope of the present invention. The storage section 28 is provided for storing the objects 14 in a stacked relationship relative to each other.

The storage section 28 defines a storage section dispensing end 32 and a generally opposed storage section inlet end 34. The storage section 28 also defines a storage section axis 36 extending between the storage section dispensing end 32 and the storage section inlet end 34. The storage section dispensing end 32, in turn, defines a dispensing port 38 for allowing selective individual dispensing therethrough of the lowermost object 14' of the stack 12 through a corresponding dispensing aperture.

Figure 3:
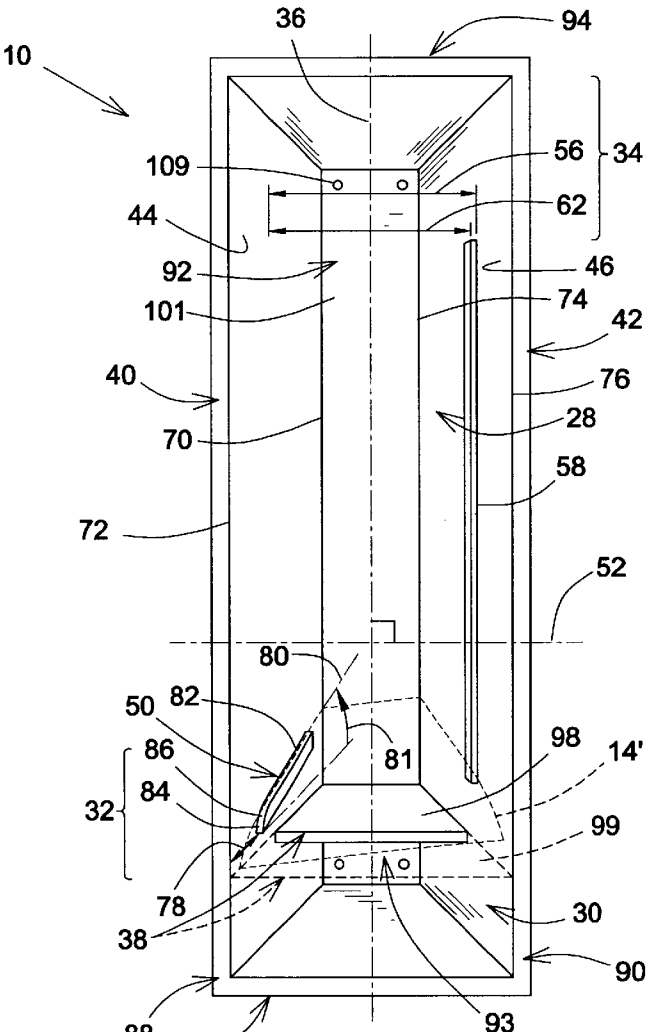
FIG. 3 is a front perspective view, showing one of the dispensing containers of FIG. 1 with a blocking wall at the dispensing port thereof.

As shown more specifically in FIG. 3, the storage section 28 includes a first storage wall 40 and a generally opposed second storage wall 42. The first and second storage walls 40, 42 typically both extend generally from the storage section dispensing end 32 to the storage section inlet end 34. Also, the first and second storage walls 40, 42 respectively define a first storage wall inner surface 44 and a generally opposed second storage wall inner surface 46.

The dispensing container 10 also includes a releasable retaining means mounted within the storage section 28 adjacent the storage section dispensing end 32 for releasably retaining the objects 14 within the storage section 28. The releasable retaining means is configured and sized for releasably supporting the object first and second main edges 18, 20 of at least the lowermost object 14' while leaving the grasping edge 22 of at least the lowermost object 14' unsupported and accessible for grasping by the hand 16 of the intended user.

As will be hereinafter disclosed in greater details, the releasable retaining means preferably support the object first and second main edges 18, 20 of at least most, if not all, of the objects 14 although, in some embodiments of the invention, the releasable retaining means needs only to support the object first and second main edges 18, 20 of the lowermost object 14'. Supporting of numerous objects 14 about their respective object first and second main edges 18, 20 reduces the percentage of the weight of the stack 12 distributed on the lowermost object 14' and, hence, also reduces the frictional force exerted between the lowermost object 14' and the stack 12 of objects 14 located above the latter. The reduced frictional force, in turn, facilitates individual dispensing of the lowermost object 14 with reduced risks of unwantingly dragging and dispensing other objects 14 simultaneously with the lowermost object 14' through the dispensing port 38.

The releasable retaining means is further configured and sized for allowing the lowermost object 14' to be deformed when grabbed by the hand 16 of the intended user. The lowermost object 14' is allowed to deform so that the object first and second main edges 18, 20 of the lowermost object 14' are allowed to clear the retaining means. The object first and second main edges 18, 20 of the lowermost object 14' being allowed to clear the retaining means, the lowermost object 14 is thus allowed to be selectively dispensed upon adequate deformation thereof through the dispensing port 38.

The releasable retaining means is preferably further configured and sized so as to allow the grasping edge 22 of the lowermost object 14' to drop through the action of gravity thereon while the object first and second main edges 18, 20 of the lowermost object 14 remain supported by the releasable retaining means. The releasable retaining means thus preferably allows gravity to deform the lowermost object 14' in such a manner that the grasping edge 22 thereof becomes spaced relative to the grasping edge 22 of an overlying object 14.

Figure 4C:
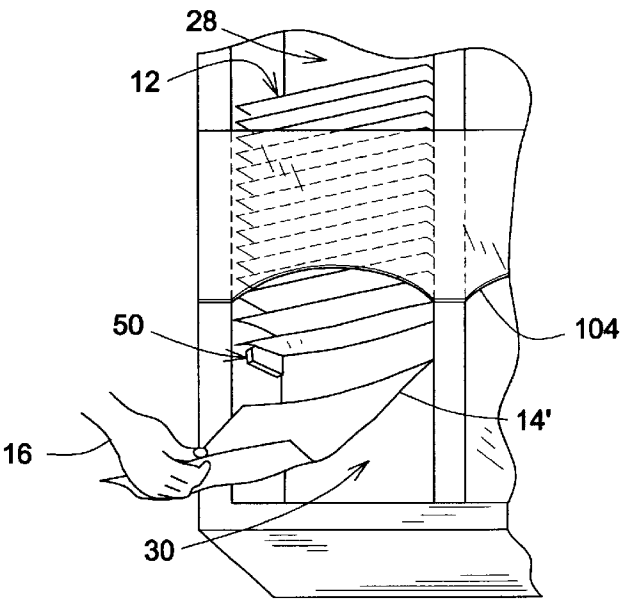

As illustrated more specifically in FIGS. 3 through 4*c*, the spaced relationship between the grasping edges of the lowermost object 14' and an overlying object 14 creates a grasping edge spacing 48 therebetween. The grasping edge spacing 48 facilitates grasping of the lowermost object 14' by the hand 16 of intended user with reduced risks of having the hand 16 of the intended user unwantingly grasp the grasping edge 22 of overlying and adjacent objects 14.

The releasable retaining means typically includes a retaining protrusion 50 extending from the first storage wall inner surface 44 adjacent the storage section dispensing end 32. The releasable retaining means typically also includes an object positioning means mounted within the storage section 28 for positioning the objects 14 in an angled configuration so that the object geometrical plane 25 of the objects 14 are angled relative to both the storage section axis 36 and a so-called reference axis 52 extending perpendicularly relative to the storage axis 36.

Although not illustrated herein, the releasable retaining means could alternatively be an elongated groove substantially acting the same way, described here below, as the retaining protrusion 50.

Each object geometrical plane 25 of at least some of the objects 14 typically defines an object angle 54 relative to the reference axis 52 which may have a value of about between zero (0) and fifty (50) degrees and preferably between ten (10) and forty-five (45) degrees. Typically, at least some of the objects 14 are angled so that the object first main edge 18 is positioned lower than the object second main edge 20. The retaining protrusion 50 is typically configured and sized for abuttingly supporting the object first main edge 18 of the lowermost object 14' when the objects 14 are in their angled configuration.

As shown in FIGS. 3 through 4*c*, when at least some of the objects 14 are in their angled configuration, a portion of the weight of the objects 14 is abuttingly supported by the frictional contact between the object first main edges 18 and the first storage wall inner surface 44. A portion of the weight of the individual objects 14 being at least partially supported by this frictional contact, the cumulative weight of the stack 12 on the lowermost object 14' is hence reduced. Again, the reduced weight of the stack 12, in turn, reduces the frictional contact between the lowermost object 14' and the stack 12 positioned above the latter. The reduced frictional contact again facilitates selective individual dispensing of the lowermost object 14' with reduced risks of unwantingly dragging and dispensing objects 14 other that the lowermost object 14'.

Although throughout the figures and the description the object first main edge 18 is shown as being on the left-hand side of the objects 14 and the first storage wall 40 is shown as being on the left-hand side of the storage section 28, it should be understood that the object first main edge 18 and the first storage wall 40 could be on the right-hand side or any other suitable location without departing from the scope of the present invention. Also, although throughout the figures the first and second storage walls 40, 42 are shown as being in a generally parallel relationship relative to each other, they could be in other relative positioning configurations without departing from the scope of the present invention.

In at least one embodiment of the invention shown in FIGS. 1 through 4*c*, the wall distance 56 between the first and second storage wall inner surfaces 44, 46 is greater or equal to the object main edge distance 26. In such situations, the positioning means includes a positioning protrusion 58 extending from the second storage wall inner surface 46. The positioning protrusion 58 defines a positioning protrusion abutment surface 60. The distance 62 between the first storage wall inner surface 44 and the positioning protrusion abutment surface 60 is dimensioned so as to be smaller that the object main edge distance 26.

As shown in FIGS. 1, 2 and 3, when the objects 14 are in their angled configuration, the object first main edge 18 abuttingly contacts the first storage wall inner surface 44 and the object second main edge 20 abuttingly contacts the positioning protrusion abutment surface 60. Preferably, the positioning protrusion 58 is a positioning strip. The positioning strip 58 is typically mounted on the second storage wall inner surface 46 using conventional mounting means such as a layer of adhesive material, a screw or any other type of fastening means.

As shown more specifically in FIG. 2, the positioning strip 58 defines a pair of positioning strip lateral edges 64. Optionally, the objects 14 are provided with at least one object retaining recess 66 formed in the object second main edge 20. The object retaining recess 66 defines a corresponding pair of object recess edges 68. The positioning strip 58 is configured and sized for substantially fitting by insertion into at least one of the object retaining recesses 66. Insertion of the positioning strip 58 within an object retaining recess 66 is typically such that at least one of the object recess edges 68 contacts one of the positioning strip lateral edges 64 allowing the positioning strip 58 to further act as a centering means and an auxiliary retaining means. Indeed, in such instances, the positioning strip 58 facilitates centering and adequate positioning of the objects 14 in a properly stacked relationship relative to each other centered within the storage section 28.

Furthermore, the frictional contact between the positioning strip lateral edges 64 and at least one of the objects recess edges 68 releasably prevents displacement of the objects 14 in the direction indicated by arrow 69 in FIGS. 1 and 2 so as to further reduce the risks of unwantingly dispensing objects 14 in frictional contact with the lowermost object 14'.

Figure 5:
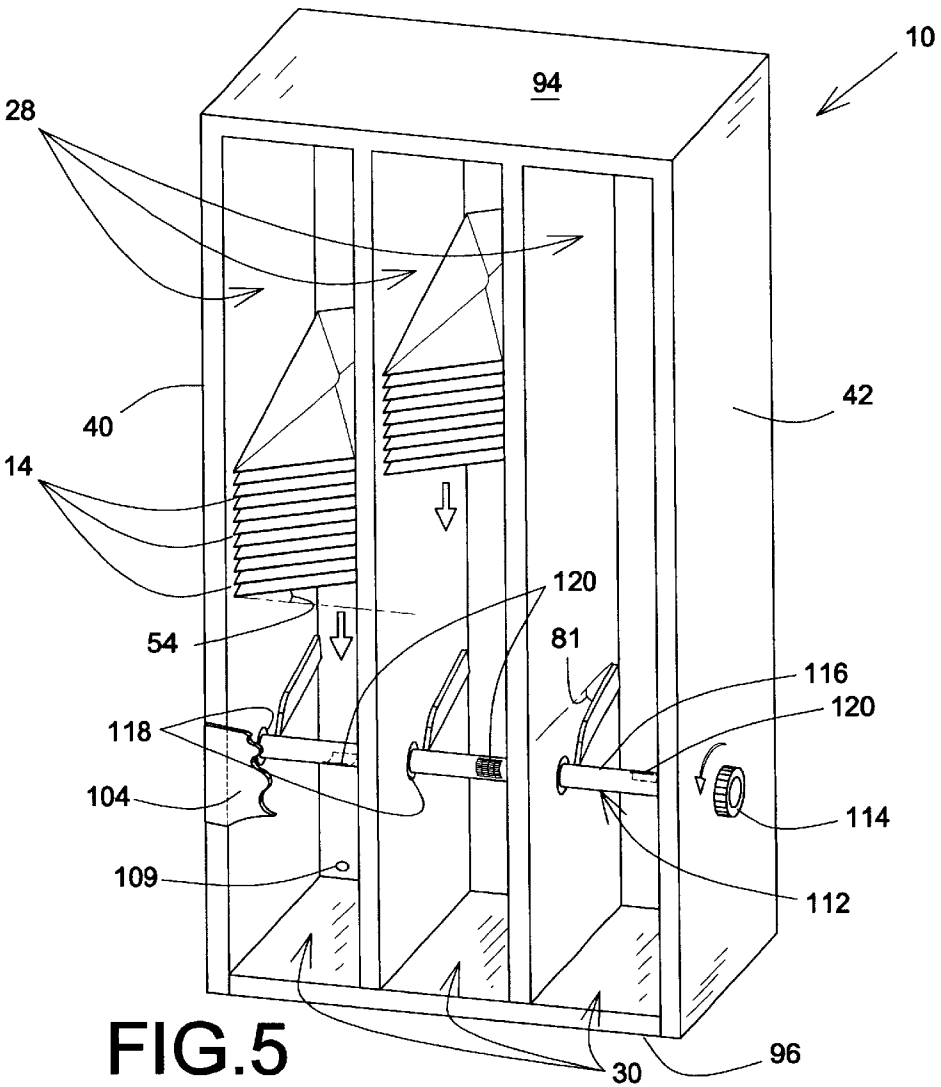
FIG. 5 is a view similar to FIG. 1, showing a dispensing container in accordance with another embodiment of the present invention with a dispensing mechanism.

In another embodiment of the invention, shown more specifically in FIG. 5, the wall distance 56 between the first and second storage wall inner surfaces 44, 46 is smaller than the object main edge distance 26. The wall distance 56 thus acts as a positioning means for positioning the objects 14 in their angled configuration. In such situations, the objects 14 are in their angled configuration, the object first main edge 18 abuts against the first storage wall inner surface 44 while the object first main edge 18 and second main edge 20 abuts against the second storage wall inner surface 46.

As illustrated more specifically in FIG. 3, the first storage wall 40 defines first storage wall first and second transversal edges 70, 72 and, similarly, the second storage wall 42 defines second storage wall first and second transversal edges 74, 76. Preferably, the retaining protrusion 50 extends from a position substantially adjacent the first storage wall first transversal edge 70 to a position intermediate the first storage wall first and second transversal edges 70, 72 so as to define a retaining protrusion-to-second edge spacing 78 between the retaining protrusion 50 and the first storage wall second edge 72. Typically, the retaining protrusion-to-second edge spacing 78 has a value of about one half to twice the length of the retaining protrusion 50.

Typically, the retaining protrusion 50 has a generally elongated configuration defining a retaining protrusion longitudinal axis 80. The retaining protrusion longitudinal axis 80 preferably extends in an angled relationship relative to both the display axis 36 and the reference axis 52. The retaining protrusion longitudinal axis 80 is preferably angled towards the dispensing port 38 in a direction leading towards the first storage wall second transversal edge 72.

Typically, the retaining protrusion longitudinal axis 80 defines a retaining protrusion angle 81 relative to the reference axis 52. The retaining protrusion angle 81 typically has a value between about minus five (−5) and fifteen (15) degrees, and more preferably between about zero (0) and fifteen (15) degrees.

Typically, the retaining protrusion 50 is a generally elongated retaining strip attached by conventional attachment means to the first storage wall inner surface 44. The retaining strip 50 defines a retaining strip supporting edge 82 and a generally perpendicular retaining strip dispensing edge 84. The intersection between the retaining strip supporting and dispensing edges 82, 84 defines a retaining strip corner 86 having a generally rounded contour. The rounded contour of the retaining strip corner 86 reduces the risks of creating an undue frictional force between the lowermost object 14' and the retaining strip 50 and also reduces the risks of scratching, tearing or otherwise damaging the lowermost object 14' when the latter is grasped and pulled by the hand 16 of the intended user during dispensing thereof. Alternatively, the protrusion strip 50 could include a roller (not shown) at the intersection between the retaining strip supporting and dispensing edges 82, 84 to significantly reduce the frictional force on the lowermost object 14' thereon.

As mentioned previously, dispensing container 10 preferably also includes a dispensing section 30 extending from storage section 28 adjacent the storage dispensing end 32. The dispensing section 30 typically includes a first dispensing wall 88 extending from the first storage wall 40 and a second dispensing wall 90 extending from the second storage wall 42. In a preferred embodiment of the invention, the first dispensing wall 88 is formed integrally with the first storage wall 40 and, similarly, the second dispensing wall 90 is formed integrally with the second storage wall 42. The first and second dispensing walls 88, 90 define a dispensing spacing therebetween.

As shown more specifically in FIG. 3, the storage container 10 typically further includes a third storage wall 92 extending between the first and second storage wall first transversal edges 70, 74. Similarly, the dispensing container 10 typically also includes a third dispensing wall 93 extending between the first and second dispensing walls 88, 90 in a generally coplanar relationship relative to the third storage wall 92.

Typically, the storage container 10 further includes a fourth storage wall 94 extending between the first and second storage walls 40, 42 adjacent the storage inlet end 34 and a fifth dispensing wall 96 extending between the first and second dispensing walls 88, 90 in a spaced relationship relative to the dispensing port 38.

Optionally, the dispensing container 10 further includes a blocking wall 98 extending from the first and second storage wall first transversal edges 70, 74 adjacent the storage section dispensing end 32 to a position intermediate the first and second storage wall first transversal edges 70, 74 and the first and second storage wall second transversal edges 72, 76. The blocking wall 98 thus extends partially across the dispensing port 38 and defines a dispensing mouth 99 while partially blocking access to the storage section dispensing end 32 through the dispensing port 38.

Figure 6:
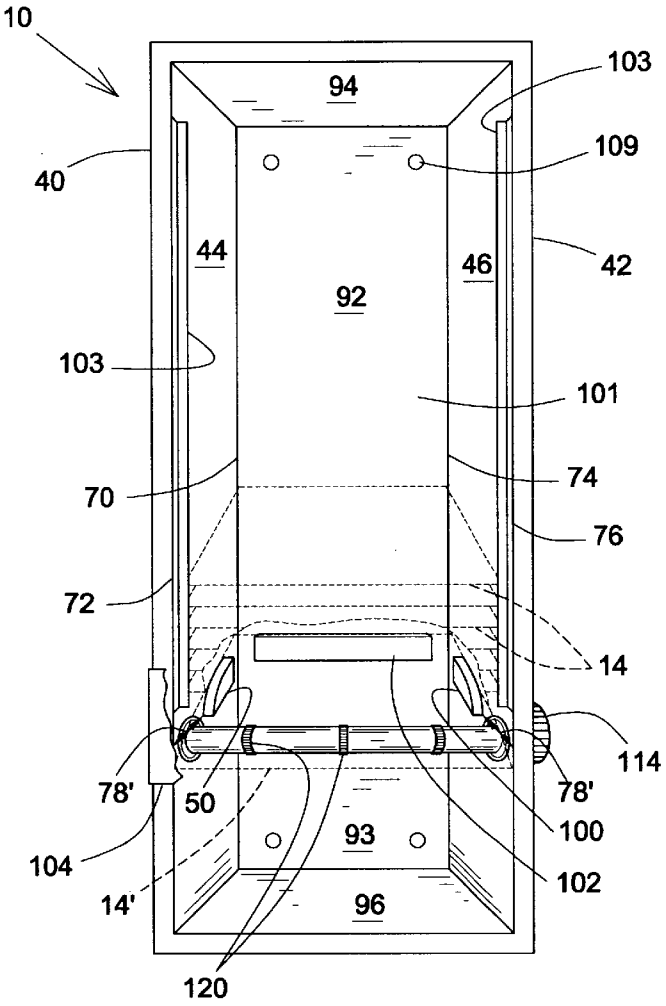
FIG. 6 is a view similar to FIG. 3, showing a dispensing container in accordance with another embodiment of the present invention with three object retaining strips for dispensing objects to be grabbed at their long edges.

In an alternative embodiment of the invention shown in FIG. 6 the releasable retaining means includes a first and a second retaining protrusion 50, 100 extending respectively from the first and second storage wall inner surfaces 44, 46. the first and second retaining protrusions 50, 100 typically extend respectively from a first and a second storage wall first transversal edges 70, 74 to a position intermediate the first and second storage wall first transversal edges 70, 74 and the first and second storage wall second transversal edges 72, 76. The first and second retaining protrusions 50, 100 both define a retaining protrusion second edge spacing 78' similar to the previously described retaining protrusion-to-second edge spacing 78.

Optionally, the retaining means further includes a third retaining protrusion 102 protruding from a third storage wall inner surface 101 defined by the third storage wall 92 adjacent the storage section dispensing end 32 and extending at least partially between the first and second storage wall first transversal edges 70, 74. The third retaining protrusion 102 cooperates with the first and second retaining protrusions 50, 100 for supporting the lowermost object 14'. The third retaining protrusion 102 may prove to be particularly useful in situations wherein the grasping and trailing edges 22, 24 are particularly long, as shown in FIG. 6. In such situations, the third retaining protrusion 102 supports part of the weight of the objects 14 preventing their unwanted deformation adjacent their respective trailing edges 24 through the action of gravity.

As illustrated in FIG. 6, in situations wherein the object angle 54 is close to zero (0) degree, the dispensing container 10 typically further includes object abutment bars 103 located on the first and second storage wall inner surfaces 44, 46 adjacent the first and second storage wall second transversal edges 72, 76, respectively, for allowing the object grasping edges 22 to abut thereon. The abutment bars 103 substantially extend along the storage section 28 between the storage section dispensing end 32 to the storage section inlet end 34.

The dispensing container 10 typically further includes a display wall 104 extending between the first and second storage walls 40, 42 adjacent the first and second storage wall second transversal edges 72, 76. The display wall 104 typically extends at least partially from the dispensing end 32 towards the storage section inlet end 34. Typically, the display wall 104 is made of a generally transparent material such as Plexiglas™ or the like and is provided with an access recess 106 formed adjacent the dispensing port 38. The display wall 104 prevents unwanted dispensing of the objects 14 in the direction indicated by arrow 69 while preferably allowing visual inspection of the stack 12 so as to allow for the monitoring of the number of objects 14 within the storage section 28. The access recess 106 allows the display wall 104 to extend to a position adjacent the dispensing port 38 so as to prevent unwanted sliding movement of the object 14 positioned above the lowermost object 14' in the direction of arrow 69 while still allowing the hand 16 of the intended user to reach the lowermost object 14'.

The dispensing container 10 optionally further includes a cover panel 108 releasably mounted over the open section of the storage section 28 and, in situations wherein a display wall 104 is present, releasably mounted over the display wall 104. Typically, the panel 108 is pivotally attached to an outer edge section of the first storage wall 40 by a suitable hinge mechanism 110. Optionally, the panel 108 is provided with a locking means, such as a key actuated locking pin 111 engaging a complementary pin opening 111' secured to the storage section 28, for releasably locking the panel 108 in a closed configuration wherein it seals off the open section of the storage section 28.

Furthermore, the dispensing container 10 is optionally provided with a mounting means for mounting the dispensing container 10 to a suitable mounting surface such as a wall (not shown) or the like. The mounting means may take any suitable form such as mounting apertures 109 provided in the storage section third storage wall 92 for receiving suitable mounting components (not shown) such as screws, bolts or the like.

As illustrated more specifically in FIGS. 5 and 6, the dispensing container 10 may further include a dispensing mechanism 112. The dispensing mechanism 112 allows for the dispensing of the lowermost object 14' upon activation of a predetermined trigger such a rotating knob 114, a push button coupled to an electronically controlled electrical motor (not shown) or any other suitable means. The dispensing mechanism 112 typically includes a selective engaging means for selectively engaging a surface of the lowermost object 14' and exerting a dispensing force thereon. The dispensing force is adapted to at least partially deform the lowermost object 14' so that the latter at least partially clears the retaining means and eventually drops through the dispensing port 38. The selective engaging means typically includes an engagement shaft 116 mounted on the dispensing container 10 adjacent the dispensing port 38 of the storage section dispensing end 32 for rotation about its longitudinal axis. The engagement shaft 116 may be provided with ball bearings 118 or other suitable means for rotational mounting through corresponding apertures 109 formed in the first and second storage walls 40, 42.

The shaft 116 is provided with an engagement protrusion 120. The engagement protrusion 120 is configured and sized for selective engagement with a predetermined surface, typically the undersurface, of the lowermost object 14'. The engagement protrusion 120 could be part of a cam configuration of the shaft 116 which may be formed or otherwise mounted on the outer surface of the shaft 116.

The engagement protrusion 120 is preferably provided with friction increasing means on its outer surface such as a textured relief, rubber-type coating or the like so as to increase the frictional contact between the engagement protrusion 120 and the undersurface of the lowermost object 14'.

In situation, such as illustrated in FIG. 5, wherein more than one storage container 10 are juxtaposed in a side-by-side relationship relative to each other, a single dispensing mechanism 112 can be used for selectively dispensing objects 14 in the various dispensing containers 10 in a predetermined pattern. For example, the engagement protrusions 120 in each dispensing container 10 can be strategically positioned so as to engage the objects 14' of the dispensing containers 10 in a predetermined pattern.

In use, objects 14 are mounted in the storage section 28 either through the storage section inlet end 34 or through the open section of the storage section 28. The objects 14 are stacked on top of each other with the lowermost object 14' in contact with the retaining means. In situations wherein the retaining means includes a retaining protrusion 50, object first main edge 18 of the lowermost object 14' is abuttingly mounted over the retaining strip supporting edge 82 of the retaining protrusion 50.

Since the retaining protrusion 50 only preferably extends partially towards the open section of the storage section 28, the grasping edge 22 of the lowermost object 14' is allowed to drop under the action of gravity creating the grasping edge spacing 48 shown in FIG. 2. Similarly, directly overlying objects 14 are also allowed to have their grasping edges 22 at least partially drop further creating similar spacings. The objects 14 adjacent the lowermost object 14' are thus preferably allowed to at least partially deform creating a fan-like pattern.

This fan-like pattern facilitates grasping or handling of the lowermost object 14' with reduced risks of unwantingly dispensing overlying objects 14. Indeed, the grasping edge spacing 48 allows the thumb and all opposed finger of the hand 16 of the intended user to grasp the lowermost object 14' with reduced risk of unwantingly grasping overlying objects 14. Furthermore, the grasping edge spacing 48 reduces the frictional contact between the lowermost object 14' and overlying objects 14.

The frictional contact between the lowermost object 14' and adjacent objects 14 is further reduced by the angled configuration of the objects 14 which transfers some of the weight of the stack 12 against the first storage wall inner surface 44. The weight transfer of the objects 14 against the first storage wall inner surface 44 decreases the frictional force on the lowermost object 14' and increases the frictional force between the overlying objects 14 and the first storage wall inner surface 44.

Figure 4B:
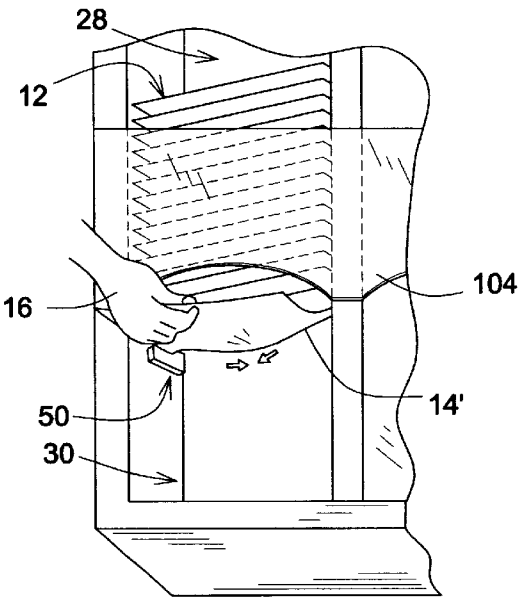
Figure 4A:
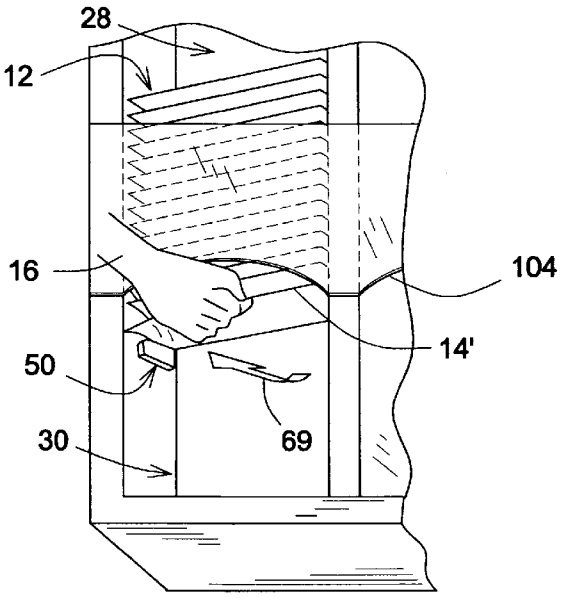

Through simple ergonomic steps illustrated in FIGS. 4*a* through 4*c*, the intended user merely needs to pull the lowermost object 14' downwardly and outwardly in the direction indicated by arrow 69. The pulling action causes the object first and second main edges 18, 20 to clear the retaining means and allows the lowermost object 14' to slide in the retaining protrusion-to-second edge spacing 78 and to drop through the dispensing port 38. In situations wherein automatic dispensing mechanism 112 is provided, similar pulling action is provided by the engagement protrusion 120. When a dispensing section 30 is used, the dispensing section creates an ergonomic spacing for facilitating the grasping operation.

Although the present dispensing container has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A dispensing container for storing a stack of relatively flexible objects and for individually dispensing a lowermost object of said stack to an intended user, each of said objects defining a object first main edge, a generally opposed object second main edge and an object grasping edge, said object first and second main edges defining an object main edge distance therebetween, each of said objects defining a corresponding object main geometrical plane intercepting said object first and said object second main edges, said dispensing container comprising:

a storage section for storing said objects in a stacked relationship to each other, said storage section defining a storage section dispensing end, a generally opposed storage section inlet end and a storage section axis extending between said storage section dispensing end and inlet ends, said storage section dispensing end defining a dispensing port; said storage section including a first storage wall and a generally opposed second storage wall each extending substantially from said storage section dispensing end to said storage section inlet end; said first and second storage walls respectively defining a first storage wall inner surface and a generally opposed second storage wall inner surface;

a releasable retaining means mounted within said storage section adjacent said storage section dispensing end for releasably retaining said objects within said storage section, said releasable retaining means being configured and sized for releasably supporting said object first and second main edges of at least said lowermost object while leaving said grasping edge of at least said lowermost object unsupported and accessible for grasping through said dispensing port;

said releasable retaining means being further configured and sized for allowing said lowermost object to be deformed when grabbed by the intended user so that said object first and second main edges of said lowermost object are allowed to clear said retaining means and said lowermost object is dispensed through said dispensing port.

2. A dispensing container as recited in claim 1 wherein said retaining means supports said object first and said object second main edges of a plurality of said objects so as to reduce the frictional force between said lowermost object and overlying stacked objects.

3. A dispensing container as recited in claim 1 wherein said retaining means is further configured and sized so as to allow said object grasping edge of said lowermost object to drop through said dispensing port under the action of gravity thereon while said object first and second main edges of said lowermost object remain supported by said retaining means so that said object grasping edge of said lowermost object becomes spaced relative to the object grasping edge of an overlying object creating a grasping edge spacing therebetween, whereby said grasping edge spacing facilitates the grasping of said object grasping edge of said lowermost object by said intended user.

4. A dispensing container as recited in claim 1 wherein said retaining means includes a retaining protrusion extending from said first storage wall inner surface adjacent said storage section dispensing end;

said dispensing container further comprising an object positioning means mounted within said storage section for positioning said objects in an angled configuration wherein the object main geometrical plane of said objects are angled relative to both said storage section axis and a reference axis perpendicular to said storage section axis, said angled configuration being such that said object first main edge is positioned lower than said object second main edge, whereby, when in said angled configuration, a portion of the weight of said objects is supported by said first storage wall with said object first main edge abuttingly contacting said first storage wall inner surface.

5. A dispensing container as recited in claim 4 wherein said objects in said angled configuration are angled by an object angle, said object angle having a value of about between zero (0) and fifty (50) degrees relative to said reference axis.

6. A dispensing container as recited in claim 4 wherein said first and said second storage walls extend in a generally parallel relationship relative to each other and define a generally perpendicular dispensing aperture therebetween, said object main geometrical plane being in an angled relationship relative to both said first and second storage walls and to said dispensing aperture.

7. A dispensing container as recited in claim 6 defining a wall distance between said first and second storage wall inner surfaces, said wall distance being greater or equal to said object main edge distance and wherein said positioning means includes a positioning protrusion extending from said second storage wall inner surface, said positioning protrusion defining a positioning protrusion abutment surface, the distance between said first storage wall inner surface and said positioning protrusion abutment surface being smaller that said object main edge distance so that when said objects are in their angled configuration, said object first main edge abuts against said first storage wall inner surface and said object second main edge abuts against said positioning protrusion.

8. A dispensing container as recited in claim 7 wherein said positioning protrusion is a positioning strip mounted on said second storage wall inner surface and extending in a direction generally parallel relationship relative to said storage section axis.

9. A dispensing container as recited in claim 8 wherein said positioning strip defines a pair of positioning strip lateral edges and wherein said objects are provided with an object retaining recess formed in said object second main edge, said object retaining recess defining a pair of object recess edges, said positioning strip being configured and sized for substantially fitting insertion in said object retaining recess, whereby when said positioning strip is inserted in said object retaining recess, at least one of said object recess edges contacts one of said positioning strip lateral edges allowing said positioning strip to further act as a centering means and an auxiliary retaining means for centering said objects in said storage section and further releasably retaining said objects in said storage section.

10. A dispensing container as recited in claim 4 wherein the distance between said first and second storage wall inner surfaces is smaller than said object main edge distance so that when said objects are in their angled configuration, said object first main edges abuts against said first storage wall inner surface and said object second main edges abuts against said second storage wall inner surface.

11. A dispensing container as recited in claim 4 wherein said first storage wall defines corresponding first storage wall first and second transversal edges and said second storage wall defines corresponding second storage wall first and second transversal edges, said retaining protrusion extending from a position substantially adjacent said first storage wall first transversal edge to a position immediate said first storage wall first transversal edge and said first storage wall second transversal edge so as to define a retaining protrusion-to-second edge spacing between said retaining protrusion and said first storage wall second transversal edge.

12. A dispensing container as recited in claim 11 wherein said retaining protrusion-to-second edge spacing has a value of about between one half to one twice the length of said retaining protrusion.

13. A dispensing container as recited in claim 11 wherein said retaining protrusion has a generally elongated configuration defining a retaining protrusion longitudinal axis, said retaining protrusion longitudinal axis extending in an angled relationship relative to both said dispensing axis and said reference axis, said retaining protrusion longitudinal axis being angled towards said dispensing port in a direction leading towards said first storage wall second transversal edge.

14. A dispensing container as recited in claim 13 wherein said retaining protrusion is a generally elongated retaining strip attached to said first storage wall inner surface, said retaining strip defining a longitudinal retaining strip supporting edge and a generally perpendicular retaining strip dispensing edge, the intersection between said retaining strip supporting edge and said retaining strip dispensing edge defining a retaining strip corner, said retaining strip corner having a generally rounded contour.

15. A dispensing container as recited in claim 1 wherein said first storage wall defines corresponding first storage wall first and second transversal edges and said second storage wall defines corresponding second storage wall first and second transversal edges, said releasable retaining means including a first and a second retaining protrusion extending respectively from said first and second storage wall inner surfaces adjacent said storage section dispensing end, said first and second retaining protrusions extending from a position substantially adjacent said first and second storage wall first transversal edges to a position intermediate said first and second storage wall first and second transversal edges so as to define respective retaining protrusion-to-second edge spacings therebetween.

16. A dispensing container as recited in claim 15 wherein said dispensing container further comprises a third storage wall extending between said first and second storage wall first transversal edges, said third storage wall defining a third storage wall inner surface, said dispensing container still further comprising a third retaining protrusion extending from said third storage wall inner surface adjacent said storage section dispensing end, said third retaining protrusion cooperating with said first and second retaining protrusions for releasably supporting said objects.

17. A dispensing container as recited in claim 4 wherein said first storage wall defines corresponding first storage wall first and second transversal edges and said second storage wall defines corresponding second storage wall first and second transversal edges, said retaining protrusion being a first retaining protrusion, said first retaining protrusion extending from a position substantially adjacent said first storage wall first transversal edge to a position intermediate said first storage wall first and second transversal edges so as to define a retaining protrusion-to-second edge spacing therebetween;

said dispensing container further comprises a third storage wall extending between said first and second storage wall first transversal edges, said third storage wall defining a third storage wall inner surface, said dispensing container still further comprising a third retaining protrusion extending from said third storage wall inner surface adjacent said storage section dispensing end, said third retaining protrusion cooperating with said first retaining protrusion for releasably supporting said objects.

18. A dispensing container as recited in claim 1 wherein said dispensing container also defines a dispensing section extending from said storage section adjacent said storage section dispensing end, said dispensing section including a first dispensing wall extending from said first storage wall and a second dispensing wall extending from said second storage wall.

19. A dispensing container as recited in claim 4 further comprising an dispensing mechanism, said dispensing mechanism including a selective engaging means for selectively engaging a surface of said lowermost object and exerting a dispensing force thereon, said dispensing force allowing said lowermost object to be deformed so that said lowermost object clears said retaining means and drops through said dispensing port.

20. A dispensing container as recited in claim 19 wherein said engaging means includes an engagement shaft rotatably mounted on said dispensing container adjacent said dispensing port, said engagement shaft being provided with an engagement protrusion formed thereon, said engagement protrusion being configured and sized for engaging a surface of said lowermost object and exerting said dispensing force thereon upon rotation of said engagement shaft.

* * * * *